US006688853B1

(12) United States Patent
Burkett et al.

(10) Patent No.: US 6,688,853 B1
(45) Date of Patent: Feb. 10, 2004

(54) CONTROL VALVE FOR REGULATING FLOW BETWEEN TWO CHAMBERS RELATIVE TO ANOTHER CHAMBER

(75) Inventors: Michael J. Burkett, Shelby, NC (US); William Page, Kings Mtn., NC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/036,514

(22) Filed: Jan. 7, 2002

Related U.S. Application Data

(60) Provisional application No. 60/260,357, filed on Jan. 8, 2001.

(51) Int. Cl.[7] ..... F04B 1/26

(52) U.S. Cl. ..... 417/222.2; 62/228.5; 251/61

(58) Field of Search ..... 417/222.2; 62/228.5; 251/61

(56) References Cited

U.S. PATENT DOCUMENTS

| | | | | |
|---|---|---|---|---|
| 5,145,326 A | | 9/1992 | Kimura et al. | 417/222.2 |
| 5,173,032 A | | 12/1992 | Taguchi et al. | 417/222.2 |
| 5,890,876 A | | 4/1999 | Suito et al. | 417/213 |
| 5,964,578 A | * | 10/1999 | Suitou et al. | 417/222.2 |
| 5,975,859 A | * | 11/1999 | Kawaguchi et al. | 417/222.2 |
| 6,010,312 A | | 1/2000 | Suitou et al. | 417/222.2 |
| 6,059,538 A | | 5/2000 | Kawaguchi et al. | 417/222.2 |
| 6,062,823 A | | 5/2000 | Kawaguchi et al. | 417/222.2 |
| 6,062,824 A | | 5/2000 | Kimura et al. | 417/222.2 |
| 6,102,670 A | | 8/2000 | Taguchi | 417/222.2 |
| 6,142,445 A | | 11/2000 | Kawaguchi et al. | 251/129.15 |
| 6,146,106 A | | 11/2000 | Suitou et al. | 417/222.2 |
| 6,352,057 B1 | * | 3/2002 | Drecq | 123/66 |
| 2002/0067994 A1 | * | 6/2002 | Kimura et al. | 417/222.2 |
| 2002/0141881 A1 | * | 10/2002 | Okada et al. | 417/222.2 |

FOREIGN PATENT DOCUMENTS

EP 0992684 A2 4/2000

* cited by examiner

*Primary Examiner*—Justin Yu
*Assistant Examiner*—William H. Rodriguez
(74) *Attorney, Agent, or Firm*—Kris T. Frederick

(57) ABSTRACT

A control valve is fluidly coupled to chambers containing fluid of different pressures for regulating flow therebetween. The control valve has a valve housing having a chamber fluidly coupled to a first chamber, a second chamber, and a third chamber. A fluid flow regulation member is disposed in the chamber and is configured to regulate fluid flow between the second chamber and the third chamber. A diaphragm is disposed substantially perpendicular to a longitudinal axis of the chamber in which longitudinal deflection of diaphragm is representative of the pressure in the first chamber.

32 Claims, 10 Drawing Sheets

CONTROL VALVE FOR REGULATING FLOW BETWEEN TWO CHAMBERS RELATIVE TO ANOTHER CHAMBER

In accordance with the provisions of 35 U.S.C. 119(e), Applicant hereby claims the priority of U.S. Provisional Patent Application No. 60/260,357, filed Jan. 8, 2001.

FIELD OF THE INVENTION

The present invention relates to a control valve, and more particularly, to a control valve for a variable displacement compressor, such as commonly used in air conditioning systems.

DESCRIPTION OF RELATED ART

FIG. 8 schematically depicts an air conditioning system, such as that used in an automobile to provide passengers a comfortable atmosphere. Air conditioning systems typically include a compressor 100, a condenser 102, an expansion device 104, and an evaporator 106 fluidly connected together by tubes or hoses 108 in which refrigerant flows. In order to condition the air before it is released to the passenger compartment, heat is removed from the air by passing the air through the evaporator 106. This causes the refrigerant to boil and form a gas, which travels from the evaporator 106 to the compressor 100. The compressor 100 serves as a pump for circulating the refrigerant through the entire system. In addition, the compressor 100 may increase the temperature and pressure of the refrigerant.

Vehicle air conditioning systems commonly use variable displacement compressors, which allow the adjustment of the refrigerant pumping capacity in response to the air conditioning load. The compressor 100 comprises three main chambers, which include a suction chamber 110, a crankcase chamber 112, and a discharge chamber 114 with a valve plate 116 separating the three chambers. This valve plate 116 contains ports fluidly coupling the suction chamber 110 to other areas of the compressor 100.

Refrigerant flowing from the evaporator 106 enters the compressor 100 through the suction chamber 110 located in the rear head 118 of the compressor 100. The refrigerant flows into the suction chamber 110 into a cylinder 122 through a port 120 where pistons 124 compress the refrigerant. The compressed refrigerant exits through discharge port 126 into the discharge chamber 128 coupled to the condenser 102 by a tube or hose 108. The pressure of the refrigerant in the discharge chamber 114 always exceeds both the pressure of the refrigerant in the suction chamber 110 as well as the crankcase chamber 112.

The pumping capacity of the pistons 124 may be adjusted by changing the inclination angle θ of a swashplate 130 relative to the compressor shaft 132. The pumping capacity corresponds to the stroke length of the piston 124. A larger stroke length corresponds to a higher pumping capacity and a higher pressure in the discharge chamber 114. Similarly, a lessening stroke length corresponds to a decreased pumping capacity and a lower pressure in the discharge chamber 114. The inclination angle θ of the swashplate 130 relates directly to the piston 124 stroke length.

The swashplate 130 is located in the crankcase chamber 112 and is connected by pivot 134 to the compressor shaft 132 and the pistons 124. The angle formed between the connection point of the swashplate 130 and the rotation of the swashplate 130 represents the inclination angle θ. The rotational movement of the compressor shaft 132 rotates the swashplate 130 causing the pistons 124 to reciprocate in their cylinders. 122. The compressor shaft 132 moves responsive to the vehicle engine via a pulley 136 with the compressor shaft 132 being mounted on radial bearings 138 and shoes 140, which allows the swashplate 130 to rotate.

The crankcase chamber 112 contains refrigerant leaked by the pistons 124. Variable displacement of the compressor 100 is obtained by varying the crankcase chamber 112 pressure Pc relative to the suction chamber 110 pressure Ps. Changing the pressure differential (Pc−Ps) between the crankcase chamber 112 and the suction chamber 110 causes the inclination angle θ of the swashplate 130 to vary, which regulates the pumping capacity of the pistons 124.

A small pressure differential (Pc−Ps) corresponds to an increased inclination angle θ. When the inclination angle θ is at its maximum, the pistons 124 reciprocate at the maximum stroke thus highest compression. At this point, the air conditioning system is at its highest cooling capacity. In contrast, an increasing pressure differential (Pc−Ps) corresponds to a decreasing inclination angle θ. Decreasing the inclination angle θ causes the pistons 124 to de-stroke resulting in lower compression. At this point, the air conditioning system is at its lowest cooling capacity.

For example, if the pressure differential Pc−Ps is low, such as 5–15 kPa, the compressor operates at maximum stroke with the swashplate 130 at its maximum inclination angle θ. In contrast, if the pressure differential Pc−Ps is high, such as 100–150 kPa, the compressor operates at minimum stroke with the swashplate 130 at its minimum inclination angle θ. At this point, the swashplate 130 is nearly perpendicular to the compressor shaft 130. A de-stroke spring 131 in FIG. 8 is provided to force the swashplate 130 to this position when cooling capacity is not needed.

Reference is made to U.S. Pat. No. 6,146,106 illustrating a control valve consistent with the prior art. FIG. 9 schematically illustrates the control valve 144 of the '106 patent which may be used with the compressor schematically illustrated in FIG. 8. The variable displacement compressor 100 uses a control valve 144 to regulate the pressure differential (Pc−Ps). The suction chamber 110 pressure Ps changes as certain parameters in the car change, such as compressor speed. This has a direct effect on the pressure differential (Pc−Ps). The control valve 144 adjusts the pressure Pc in the crankcase chamber 112 relative to the pressure Ps in the suction chamber 110 in order to reach an equilibrium point. The equilibrium point is the set pressure differential (Pc−Ps) value of the control valve. By maintaining a constant pressure differential (equilibrium point), the cooling air entering the passenger compartment stays relatively constant regardless of changing parameters.

The control valve 144 regulates the flow of refrigerant from the discharge chamber 114 having a discharge chamber pressure Pd to the crankcase chamber 112 relative to the pressure of the refrigerant in the suction chamber 110. The control valve 144 contains a bellows 146, which compresses or expands as a result of an increase or decrease, respectively, of the fluid in the suction chamber 110. When there is a high pressure differential Pc−Ps, the control valve 144 allows more refrigerant to flow from the discharge chamber 114 into the crankcase chamber 112 than can escape to the suction chamber 110 through flow passage 148. The flow passage 148 is sized so that the amount of flow from crankcase chamber 112 to suction chamber 110 is less than the flow from the discharge chamber 114 to the crankcase chamber 112. As a result, the crankcase chamber pressure Pc increases, causing the compressor 100 to de-stroke. When the compressor 100 de-strokes, the suction chamber pressure Ps increases as a result of reduced refrigerant flow out of the compressor 100. The bellows 146 of the control valve 144 responds accordingly, reducing the flow into the crankcase chamber 112 until equilibrium is reached.

The bellow 146 connects to a poppet 150 or other type of member for regulating the flow from the discharge chamber 114 to the crankcase chamber 112. When the compressor 100 begins to de-stroke as the result of a high-pressure differential, the suction chamber 110 pressure increases. The fluid from the suction chamber 110 acts on the exterior of the bellows 146. An increasing suction chamber 110 pressure causes the bellows 146 to decrease in length. This moves the poppet 150 in a direction to reduce the flow from the discharge chamber 114 to the crankcase chamber 112 until the poppet 150 rests at the equilibrium point. Traditionally, the equilibrium point had a fixed setting, i.e. a set pressure differential between the crankcase chamber 112 and the suction chamber 110.

With the development of improved air conditioning systems and an increased emphasis on fuel economy, it was desired to vary the equilibrium point for a closer matching of compressor capacity to load. Solenoid-actuated control valves provide one means for varying the equilibrium point. The solenoid-actuator 152 connects to the poppet 150, which regulates fluid flow between the discharge and crankcase chamber 114, 112. As such, the solenoid actuator 152 may vary the fluid flow regardless of the pressure from the suction chamber 110. This in turn varies the equilibrium point. An electrical controller 154 connects to the solenoid for varying the amount of current supplied to the solenoid. The amount of supplied current may be set in response to various parameters, such as engine speed, vehicle speed, cabin air temperature, etc. This in turn moves the poppet 150 to a different equilibrium point.

The resultant design incorporated a mechanical bellow control valve with an electrical solenoid-actuator. This design, however, presents certain concerns. Compressors in vehicles must operate in a wide range of conditions. These conditions range from extreme heat to extreme cold. Moreover, compressors experience significant amounts of vibration from the road, vibration of the engine, etc. As a result, the bellows undergoes significant amounts of wear and tear, which reduces the bellows' useful life. As the bellows are relatively long, the vibrations cause the bellows to vibrate and contact the internal surfaces of the control valve. Over time, the bellows have been observed to break down and lose their resiliency resulting in a less efficient air conditioning system. Once a bellows fails, typically the complete control valve must be replaced in order for the air conditioning system to work properly. However, bellows require a significant manufacturing process, increasing their replacement cost.

Accordingly, a need exists to increase the useful life of a vehicle air conditioning system, and for a control valve that will better resist the hostile environment conditions experienced in a vehicle compressor.

SUMMARY OF THE INVENTION

These and other needs are met by the present invention, which provides a variable displacement compressor having a suction chamber, a crankcase chamber, and a discharge chamber. The crankcase chamber and discharge chamber are fluidly coupled by a valve for regulating the flow therebetween as a function of pressure in the suction chamber. The valve comprises a valve housing having a chamber fluidly coupled to the suction chamber, the crankcase chamber, and the discharge chamber. The fluid flow regulation member is disposed in the chamber and is configured to regulate fluid flow between the crankcase chamber and the discharge chamber. A diaphragm is disposed substantially perpendicular to a longitudinal axis of the chamber and acts on the fluid flow regulation member as a function of the pressure in the suction chamber, the amount of longitudinal deflection of the diaphragm being responsive to the pressure in the suction chamber.

The control valve may be applied to other applications requiring the regulation of flow between two chambers relative to another chamber. This control valve is fluidly coupled to chambers containing fluid of different pressures for regulating flow therebetween. The control valve comprises a valve housing having a chamber fluidly coupled to a first chamber, a second chamber, and a third chamber. A fluid flow regulation member is disposed in the chamber and is configured to regulate fluid flow between the second chamber and the third chamber. A diaphragm disposed substantially perpendicular to a longitudinal axis of the chamber in which longitudinal deflection of diaphragm is representative of the pressure in the first chamber.

The deflection of the diaphragm discussed above acts on the fluid flow regulation member. The diaphragm has an outer perimeter shape substantially corresponding to the shape of the chamber perpendicular to the longitudinal axis. The diaphragm is configured to deflect in a first axial direction as a function of increasing force acting on the diaphragm and deflect in a second axial direction as a function of decreasing force acting on the diaphragm. In contrast, embodiments of the invention, the diaphragm comprises an undulation having at least one ridge and at least one groove. This undulation of the diaphragm compresses or expands along the axis perpendicular to the longitudinal axis of the chamber with the longitudinal deflection of the diaphragm. The outer periphery of the diaphragm is hermetically sealed to the inner wall of the chamber creating a volume between the diaphragm and an end of the chamber. A vacuum exists in this volume.

The foregoing and other features, aspects, and advantages of the present invention will become more apparent from the following detailed description of the present invention when taken in conjunction with the accompanying drawings.

DETAILED DESCRIPTION OF THE INVENTION

The present invention addresses and solves problems associated with the degradation of control valves and more particularly to control valves in variable displacement compressor systems. A diaphragm is provided to form a pressure control member, which increases the useful life of the control valve.

Figure 1A:
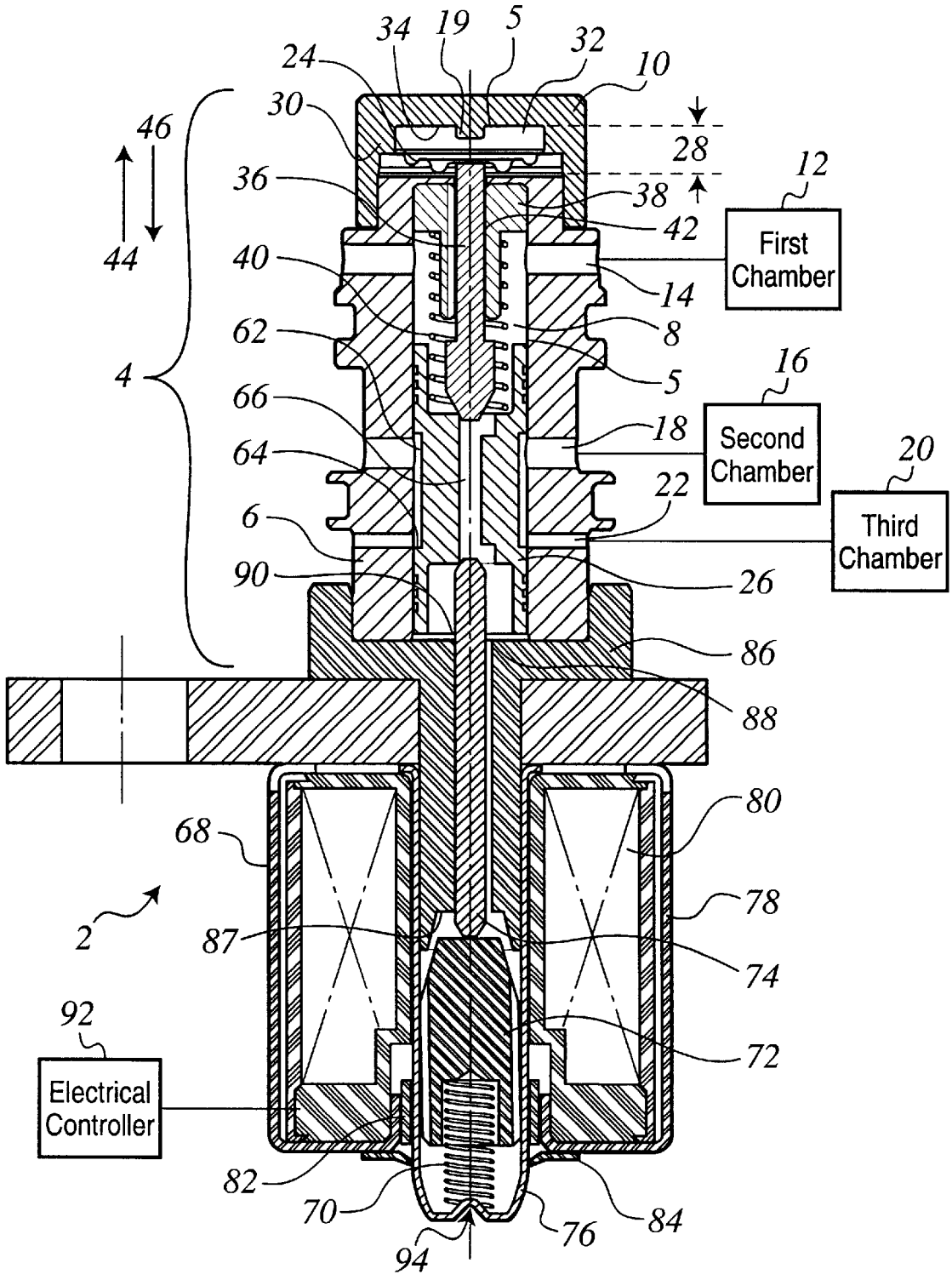
FIG. 1*a* depicts a cross-sectional view of the control valve of the present invention.
Figure 1B:
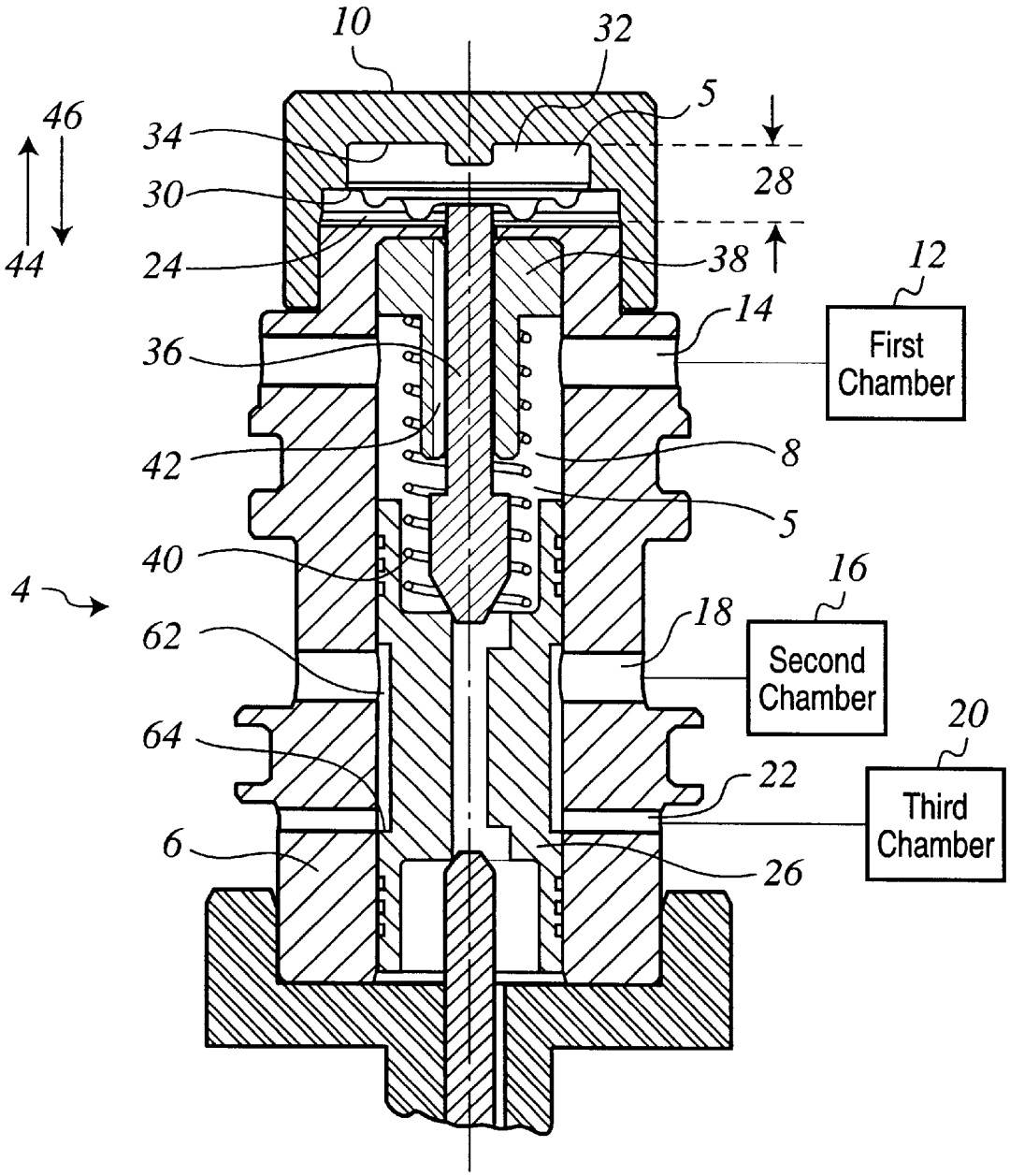
FIG. 1*b* depicts a cross-sectional view of the valve housing of the control valve illustrated in FIG. 1*a*.
Figure 8:
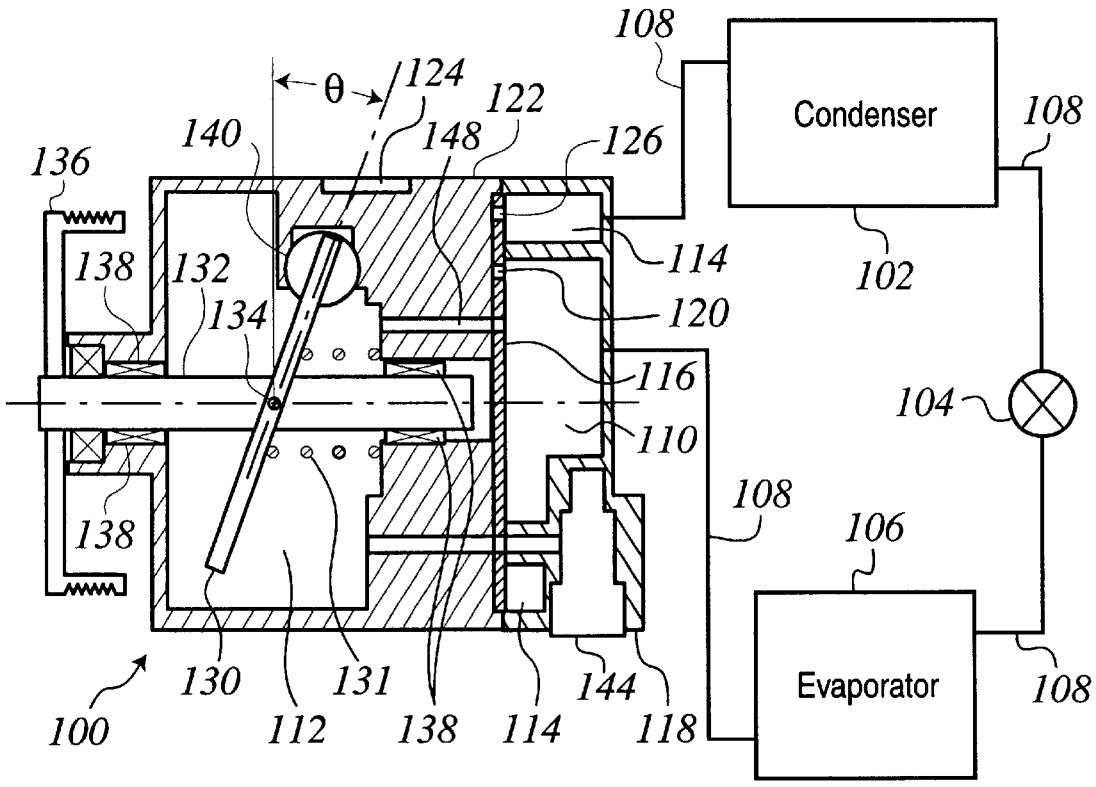
FIG. 8 Prior Art
FIG. 8 schematically depicts an air conditioning system using a variable displacement compressor of the prior art, in which the control valve of the present invention can be employed.
Figure 9:
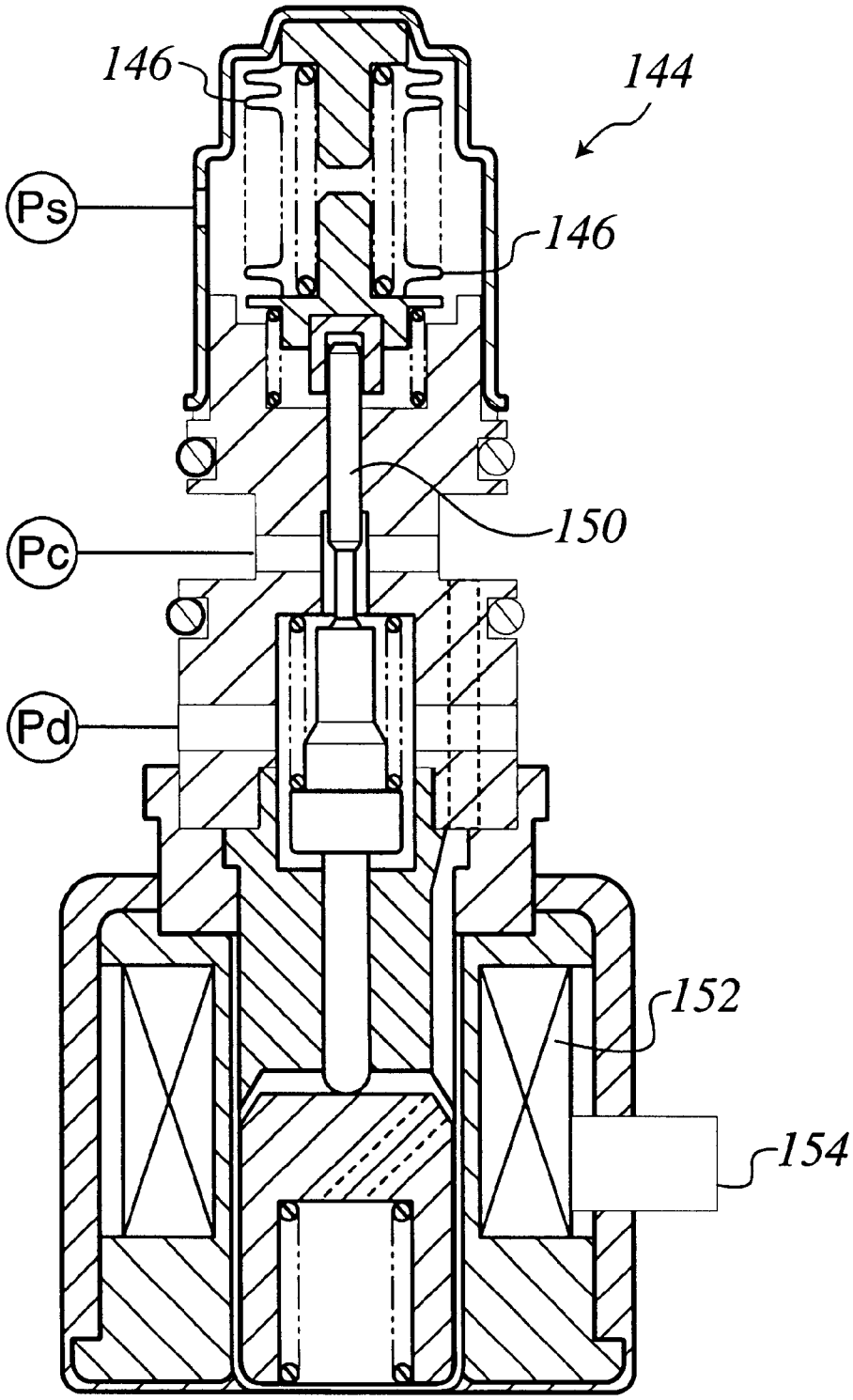
FIG. 9 Prior Art
FIG. 9 schematically illustrates a control valve of the prior art incorporating a bellows.

FIGS. 1*a* & 1*b* depict a cross-sectional view of the control valve 2 and the valve housing 4 of the control valve 2, respectively, of the present invention. This control valve 2 may be incorporated into a variable displacement compressor 100 of the prior art, such as that shown in FIG. 8. However, the control valve 2 may also be used with other applications requiring a control valve 2 responsive to pressure differentials.

The control valve 2 comprises a valve housing 4 having an inner chamber 5. The valve housing 4 comprises a valve body 6 that is substantially cylindrical and a housing cap 10. A first chamber 12 is fluidly coupled to the inner cavity 8 via a first fluid port 14 through the valve body 6; a second chamber 16 via a second fluid port 18; and a third chamber 20 via a third fluid port 22. In this inner cavity 8, the control valve 2 controls fluid flow between the second chamber 16 and third chamber 20 as a function of the pressure in the first chamber 12.

A pressure control member 24 and a fluid flow regulation member 26 are both disposed in the chamber 5 of the valve housing 4. The pressure control member 24 comprises a diaphragm 24, which deflects a longitudinal direction (axial) direction with changes in fluid pressure from the first chamber 12. The diaphragm 24 replaces the bellows traditionally used in control valves for controlling pressure. The diaphragm 24 controllably deflects as a function of changing pressure of the fluid received from the first chamber 12, as a bellows 146 is designed to do. However, the diaphragm 24 corrects certain problems associated with a bellows 146. The described diaphragm 24 assembly occupies significantly less volume as compared to the bellows design described by the prior art. As a result, the overall control valve 2 may be made much smaller compared to conventional designs. Since the diaphragm 24 is constructed of a rigid material and occupies significantly less volume, the diaphragm 24 resists the vibrations common in control valve 2 applications and therefore does not rub against opposing surfaces. As a result, the diaphragm 24 does not experience the same wear, as does a traditional bellows design.

The diaphragm 24 is contained by the valve housing 4 in a cavity 28 separate from the inner cavity 8. The housing cap 10 mounts on one end of the valve body 6 forming the valve housing 4. The housing cap 10 forms a cavity 28 wherein the diaphragm 24 is mounted. Both the inner cavity 8 and cavity 28 form the inner chamber 5 of the valve housing 4. The housing cap 10 may be press-fit to the valve body 6 or secured by other suitable means. The diaphragm 24 is hermetically sealed to a flange 30 in the inner wall of the housing cap 10. This creates a volume 32 between the diaphragm 24 and the underside surface 34 of the housing cap 10. It is preferable for a substantial vacuum to exist in this volume 32. Absent a vacuum, the diaphragm 24 would have very limited deflection characteristics. To create a vacuum, the diaphragm 24 is hermetically sealed to the flange 30 housing cap 10 under vacuum conditions. Once hermetically sealed and removed from the vacuum conditions, the volume 32 retains the vacuum applied during assembly. The diaphragm 24 may be hermetically sealed by electron beam welding, laser welding, pressing and retaining an O-ring, brazing, or other suitable means to create a hermetic seal.

As another alternative, the volume 32 may be filled with a gas having an expansion rate different from the expansion rate of the fluid received from the first chamber 12. The expansion rate of the gas and fluid typically correspond to a change in temperature of the gas or fluid The selection of gas allows a designer to control the deflection characteristics of the diaphragm and the overall operating characteristics of the system to which the control valve 2 is applied.

A pin 36 is provided with one end interacting with the diaphragm 24 and the other end communicating with the fluid flow regulation member 26. A stop member 38 attached at one end of the inner cavity 8 secures one end of the spool spring 40, and provides a guide for the pin 36. The stop member 38 has a central aperture 42 in which the pin 36 may reciprocate. The central aperture is aligned with an aperture in the valve body 6 such that the pin 36 is constrained to move axially through both apertures and contact the diaphragm 24. Fluid from the first chamber 12 enters the inner cavity 8 through the first fluid port 14 and acts on the pin 36. An increase in pressure of the fluid from the first chamber 12 correlates to an increased force acting on the pin 36. This causes the diaphragm 24 to deflect in a first axial direction 44. The pin 36 moves in the first axial direction 44 against the diaphragm 24 by an amount equal to the diaphragm 24 deflection. A decrease in pressure of the fluid from the first chamber 12 correlates to a decreased force acting on the pin 36. Since the diaphragm 24 tends to return to its original shape, the diaphragm 24 forces the pin 36 in a second axial direction 46 as a result of the decreased pressure. The pin 36 thereby communicates the movement of the diaphragm 24 in either direction to the fluid flow regulation member 26, discussed below.

In certain embodiments, the diaphragm 24 may be made of a rigid material, such as stainless steel, a Kapton polymer, and the like. The diaphragm 24 may be stamped from a sheet of material to form the desired shape. A designer should assess the common operating pressure range of the first chamber 12 and select a diaphragm 24 material and shape accordingly. It is preferred to select a material with a rigidity and shape such that at minimum pressure, the diaphragm 24 is in its original form, and at maximum pressure, the diaphragm 24 deflects to a maximum deflection position. Moreover, a material should be chosen that will resist any caustic effects of the fluid from the first chamber 12 if fluid were to leak into cavity 28.

Figure 2:
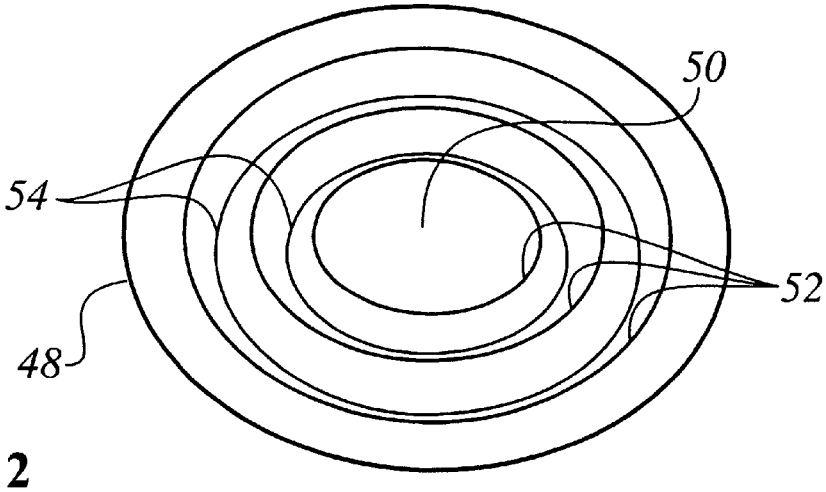
FIG. 2 depicts an oblique view of one embodiment of the diaphragm.
Figure 3A:
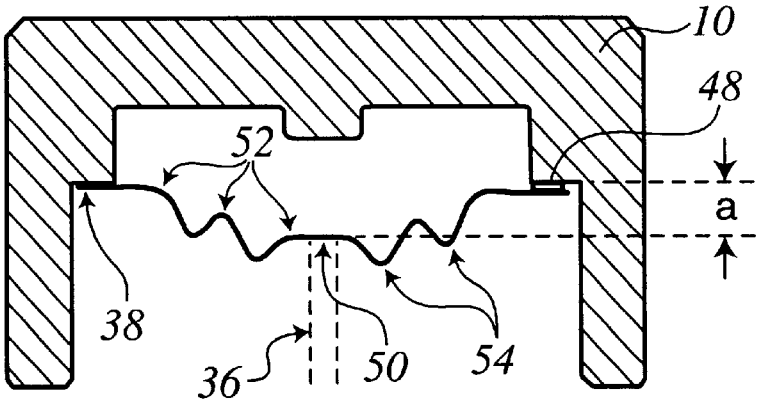
FIG. 3*a* depicts the diaphragm of FIG. 2 in a state of no deflection.
Figure 3B:
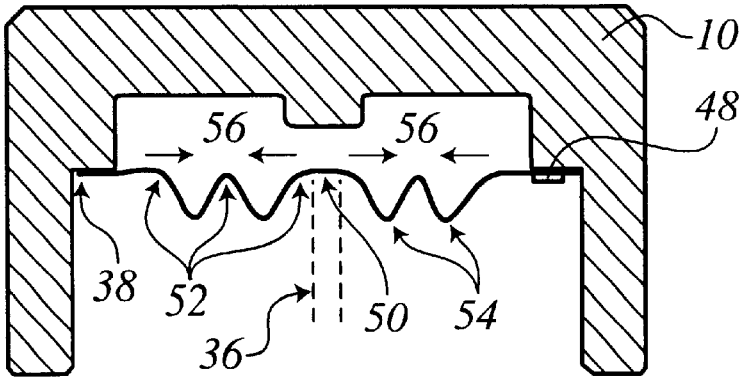
FIG. 3*b* depicts the diaphragm of FIG. 2 in a first deflection state.
Figure 3C:
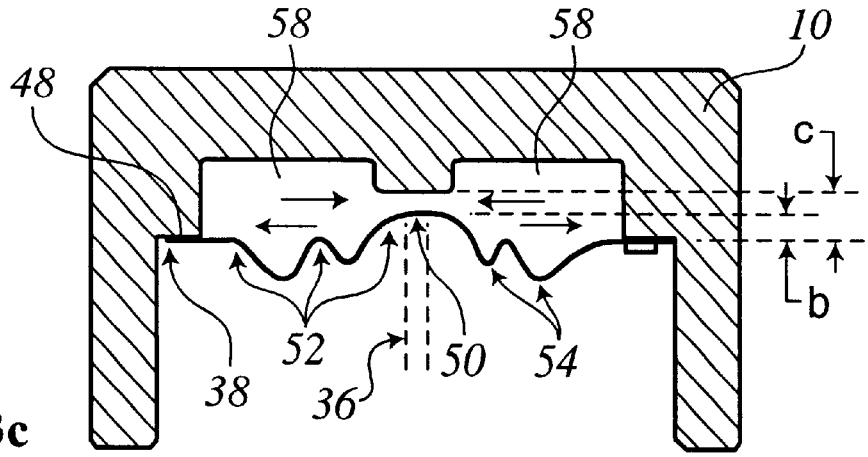
FIG. 3*c* depicts the diaphragm of FIG. 2 in a second deflection state.
Figure 4:
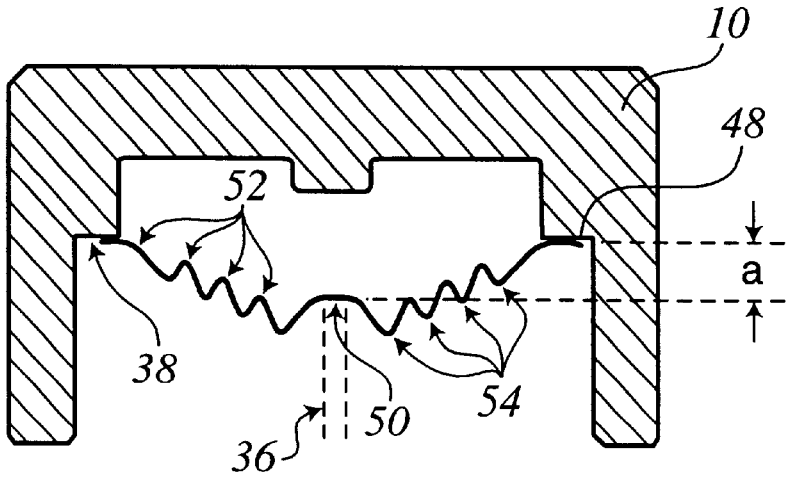
FIG. 4 depicts a diaphragm having a high undulation frequency.

FIG. 2 depicts an oblique view of an exemplary diaphragm shape. FIGS. 3*a–c* schematically illustrate the diaphragm of FIG. 2 in a first, second, and third deflection state, respectively. As illustrated, the diaphragm 24 is disc-shaped and is corrugated to form an undulation from the diaphragm's 24 outer periphery 48 towards the center 50. The undulation, which introduces yield or give into the diaphragm 24, is a series of small ridges 52 and grooves 54 terminating towards the center 50 of the diaphragm 24. As illustrated in FIG. 3*a*, the diaphragm 24 shape has center portion 50 extending perpendicularly outwards with respect to a reference plane in line with the outer periphery 48 of the diaphragm 24 at a predetermined distance "a". Increasing the frequency of undulation, illustrated by FIG. 4, introduces a greater yield into the diaphragm 24. In other words, less force is required to deflect the diaphragm 24 with a higher frequency of undulation. A designer should consider the maximum pressure and force exerted by the fluid from the first chamber 12 in designing the diaphragm 24. The diaphragm 24 should have a rigidity and an undulation frequency such that the diaphragm 24 deflects to a maximum position when the fluid from the first chamber 12 is at a maximum pressure and a maximum force is applied against the diaphragm 24 by a solenoid actuator 68 discussed below.

The following provides a description of the forces acting on the diaphragm 24 as the result of an axial force applied at the center 50 of the diaphragm 24. When the diaphragm 24 deflects in the first axial direction 44, as illustrated by FIG. 3*b*, each ridge 52 and groove 54 moves closer to an adjacent ridge 52 and groove 54, respectively. In other words, the undulation portion of the diaphragm 24 compresses in the direction perpendicular to the axial deflection, the horizontal direction. The amount of compression corresponds to the predetermined distance "a". When the center 50 of the diaphragm 24 is in the same plane as its periphery 48 (distance "a"=0) as illustrated by FIG. 3*b*, the diaphragm 24 is at a maximum compression. Compression arrows 56 illustrate the compression force acting on the diaphragm 24. As illustrated by FIG. 3*c*, when the center 50 of the diaphragm 24 moves in the first axial direction 44 past a reference plane in line with the outer periphery 48 of the diaphragm 24 by a distance "b", the undulation portion of the diaphragm 24 expands, i.e. the ridges 52 and grooves 54 move away from adjacent ridges 52 and grooves 54, respectively. The expansion forces acting on the diaphragm 24 are illustrated by expansion arrows 58. At maximum deflection distance "c", the diaphragm 24 contacts a stop surface 60 on the underside surface 34 of the housing cap 10.

The total deflection of the diaphragm equals distance "a" plus distance "c". When determining the frequency of undulation, the designer should consider the corresponding deflection distances "a" and "c". For example, assume that one control valve 2 design requires the distance "a" be one distance unit and a second design requires the distance "a" be two distance units. For each design to function within the same pressure range, the second design would require a higher frequency of undulation than the first design to account for the increased total deflection.

Figure 5A:
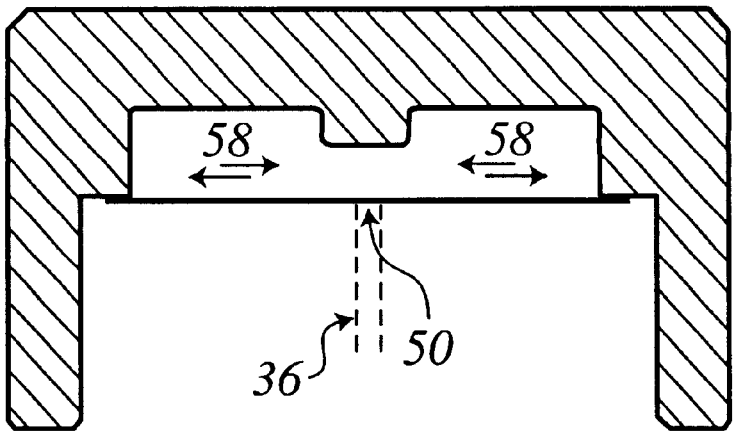
FIG. 5*a* depicts a substantially planar diaphragm in accordance with certain embodiments of the invention.
Figure 5B:
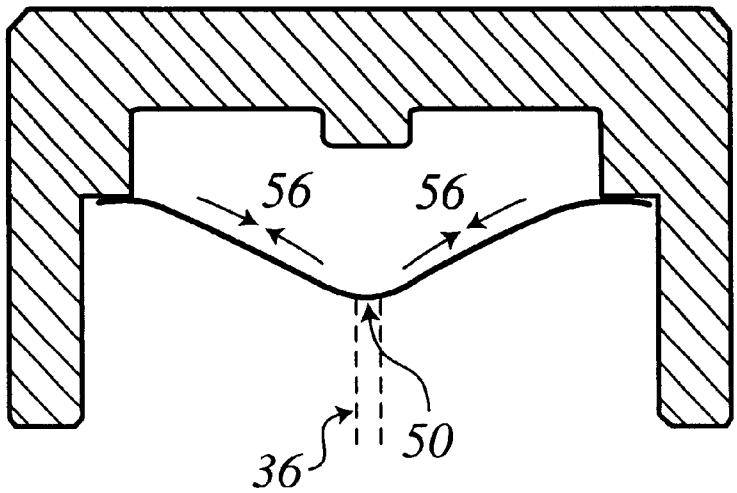
FIG. 5*b* depicts a convex shaped diaphragm in accordance with embodiments of the invention.

The shape of the diaphragm 24 correlates to the force required to deflect the diaphragm 24 in the first axial direction 44. For example, if the diaphragm 24 is flat absent an undulation portion as illustrated in FIG. 5*a*, the force required to deflect the diaphragm would be considerable, as the diaphragm 24 material must expand. The considerable amount of force required is a result of little yield in the diaphragm 24 due to the absence of an undulation portion to account for the expansion forces 58 acting on the diaphragm 24. If the diaphragm 24 is convex in shape and absent an undulation as illustrated in FIG. 5*b*, a substantial force would also be required to deflect the diaphragm 24 in the first axial direction 44. The diaphragm 24 again contains little yield due to the absence of an undulation portion to accommodate the compression forces 56.

The pin 36 (seen in FIGS. 1*a* and 1*b*) communicates the axial deflection of the diaphragm 24 to the fluid flow regulation member 26. As illustrated in FIGS. 1*a* & 1*b*, the fluid flow regulation member is provided by a spool 26 disposed in the inner cavity 8 of the valve body 6. The spool 26 is cylindrical with a diameter corresponding to inner diameter of the inner cavity 8. The spool 26 has a groove 62 around its outer periphery, which spans the second fluid port 18 and the third fluid port 22. The volume created by the groove 62 and the wall of the inner cavity 8 contains fluid from the second and third chambers 16, 20 within the volume. Fluid from the first chamber 12 introduced into the inner cavity 8 through the first fluid port 14 is prevented from interacting with the fluid from the second and third chamber 16, 20 by the spool 26.

The spool 26 reciprocates within the inner cavity 8 responsive to a force applied in the first axial direction 44 by a solenoid actuator 68 and a force applied in the second axial direction 46 by the diaphragm 24 via the pin 36 and spool spring 40. The functions of the solenoid actuator 68 and the spool spring 40 are discussed below. The opposing forces acting on the spool 26 regulate the rate of fluid flow between the second chamber 16 and the third chamber 20 as a function of the pressure in the first chamber 12. When the spool 26 moves axially, the edge 64 of the groove 62 passes over the third fluid port 22. Depending on the direction of movement, the third fluid port 22 is either increasingly or decreasingly closed to regulate the fluid flow rate.

In addition to the pin 36 movement, the spool spring 40 biases the spool 26 in the second axial direction 46. In one embodiment, the spool spring 40 is coiled around the pin 36 but is not physically attached to the pin 36. One end of the spool spring 40 rests on the stop member 38 with the spring circumference surrounding the aperture 42 through which the pin 36 passes. This allows both the pin 36 and the spool spring 40 to move freely with respect to one another. The pin 36 does, however, keep the spool spring 40 from buckling to one side when the spool spring 40 is compressed. The spool spring 40 may also be provided separate from the pin 36. However, for the above reasons, it is preferred that the spool spring 40 is coiled around the pin 36.

The fluid from the first chamber 12 enters the inner cavity 8 through first fluid port 14 positioned below the pin 36 and diaphragm 24. An increase in fluid pressure from the first chamber 12 forces the pin 36 in the first axial direction 44. However, in order to avoid the same force acting on the spool 26 which would force the spool 26 in the second axial direction 46, fluid from the first chamber 12 flows through a spool aperture 66 to the opposite end of the spool 26. As a result, the pressure of the fluid acts equally on each end of the spool 26; changes in the pressure of the first chamber 12, therefore, have no direct effect on the spool 26 movement. The only effect of the pressure is that communicated by the diaphragm 24 via pin 36.

As illustrated by FIG. 1*a*, the solenoid-actuator 68 of the control valve 2 generates an opposing force acting on the spool 26 against the diaphragm 24 and spool spring 40. The diaphragm 24 provides feedback to maintain the pressure differential point for a given applied solenoid current. The solenoid actuator 68 comprises an armature spring 70, an armature 72, and a rod 74 contained in an armature housing 76. A coil housing 78 enclosing a coil 80, which carries a magnetic flux, surrounds the armature housing 76. Current applied to the coil 80 creates a magnetic flux generated by coil 80 acting on the armature 72 attracting it towards the pole surface 87. The armature 72 and rod 74 move in the second axial direction 44. A flux ring 82 disposed between the coil housing 78 and armature housing 76 directs the magnetic flux to the armature spring 70 and armature 72. Retaining clips 84 secure the coil housing 78 to the armature housing 76.

In order to integrate the solenoid actuator 68 with the valve housing 4 and more particularly, the valve body 6, a pole section 86 is mounted between the valve body 6 and the armature housing 76. One end of the pole section 86 has an outer diameter consistent with the inner diameter of the armature housing 76. The other end flanges radially outwards in which the valve body 6 is disposed. The valve body 6 and the armature housing 76 are hermetically sealed to the pole section 86 to prevent fluid leakage. The pole section 86 has a central aperture 88 in line with an aperture 90 of the valve body 6. The rod 74 reciprocates within apertures 88, 90 with one end interacting with the spool 26 and the other end with the armature 72. The armature spring 70 is disposed with one end on the armature housing 76 and the other end interacting with the armature 72.

The spool spring 40 is of a length such that when no electric current is applied to the coil 80, the diaphragm 24 in an undeflected state does not apply a force via pin 36 on the spool 26. Also, the lengths and stiffness of the spool spring 40 and the armature spring 70 are chosen such that the groove 62 of the spool 26 spans both the second and third fluid ports 18, 22 when no electrical current is applied to the coil 80. Additionally, the spool spring 40 forces the rod 74, armature 72, and armature spring 70 in the second axial direction 46.

When the solenoid actuator 68 force applied to the spool 26 in the first axial direction 44 equals the force in the second axial direction 46, the spool 26 does not move. At this point, there is a constant fluid flow between the second chamber 16 and the third chamber 20. This point is also known as the equilibrium point. In other words, the equilibrium point is the point at which the force applied by the diaphragm 24 via pin 36 and spool spring 40 equals the opposing force applied by the solenoid actuator 68. The equilibrium point also represents the corresponding pressure differential between the first and second chambers 12, 16. An electric controller 92 connects to the solenoid actuator 68 to vary the current and thus the equilibrium point.

The solenoid actuator 68 may be replaced with a spring, diaphragm, or other type of resilient element to force the spool 26 in the first axial direction 44. However, in this case, the control valve 2 would have a fixed equilibrium point, as one could not vary the applied force in the first axial direction 44. Such configurations can be advantageous depending on the control valve's 2 application.

In the manufacture of the control valve 2, the diaphragm 24 and spool spring 40 should be chosen to have deflection characteristics to correspond to the minimum current I(1) and maximum current I(2) applied to the coil 80 of the solenoid actuator 68. At minimum current I(1), the spool spring 40 should force the spool 26 to a position where fluid flow between the second and third chambers 16, 20 is maximized. At the second current I(2), the solenoid actuator 68 should force the spool 26 to a position of minimum flow between the second and third chambers 16, 20. At this point, both the spool spring 40 and diaphragm 24 will be at a maximum deflection.

As the diaphragm 24 allows the control valve 2 to be manufactured significantly smaller than prior art control valves, each element of the control valve 2 is preferably manufactured to greater precision. Therefore, the position of the spool 26 may need fine tuning after manufacture. For example, after assembly, if the flow rate at the applied current I(1) or I(2) does not meet specifications, the end 94 of the armature housing 76 may be deformed inwards.

This adjustment moves the armature spring 70, armature 72, rod 74, and spool 26 in the first axial direction 44 thereby altering the fluid flow rate between the second and third chamber 16, 20.

Figure 6A:
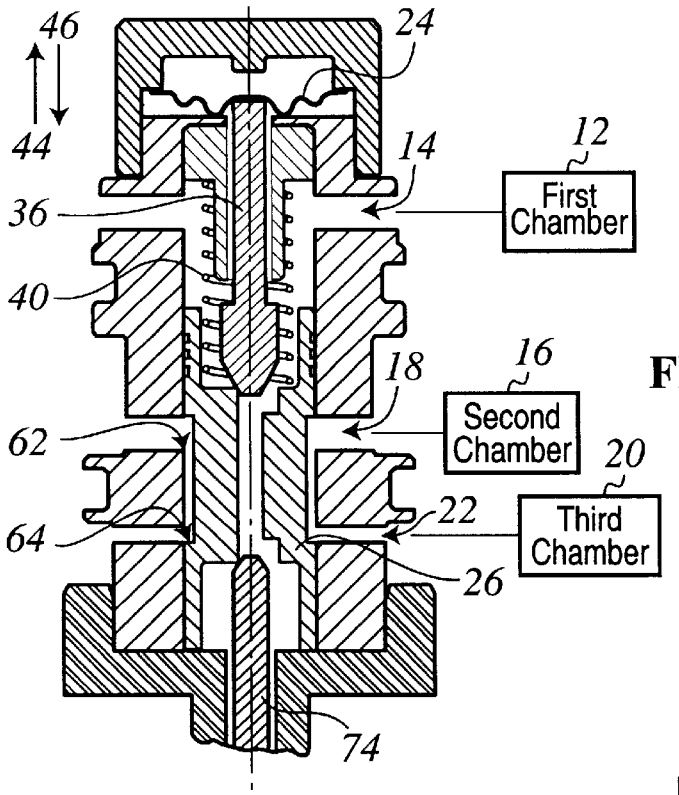
FIG. 6*a* schematically illustrates a valve housing with a diaphragm in a state of no deflection.
Figure 6B:
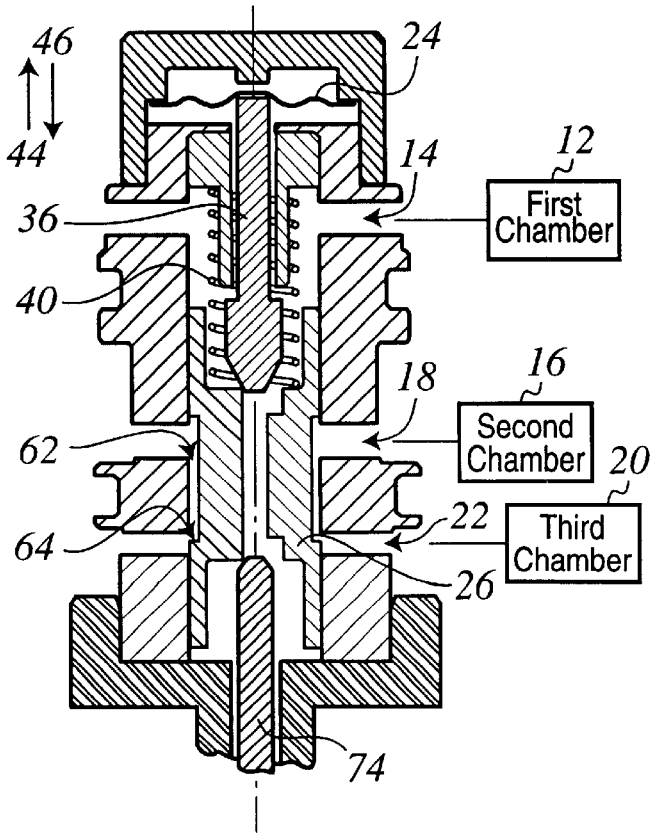
FIG. 6*b* schematically illustrates the valve housing with a diaphragm in a first state of deflection.
Figure 6C:
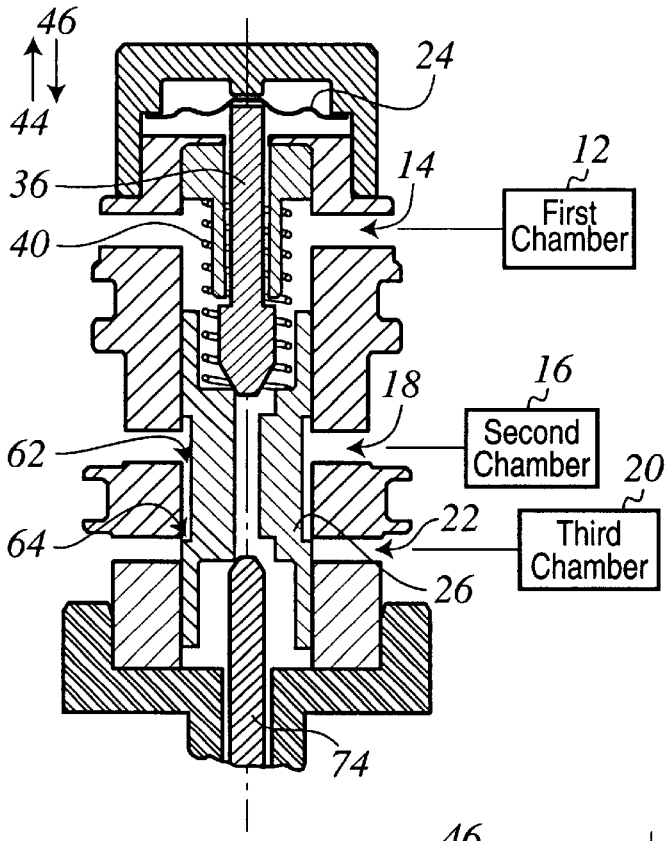
FIG. 6*c* schematically illustrates the valve housing with a diaphragm in a maximum deflection state.

Referring to FIGS. 6*a–c*, the following discusses the movement of the diaphragm 24, pin 36, spool 26, and solenoid actuator 68. In each of the figures, the solenoid actuator 68 is not shown. However, the position of the rod 74 illustrates the corresponding force, i.e. current, applied by the solenoid actuator 68.

FIG. 6*a* schematically illustrates the diaphragm 24 in an undeflected state and the current I(1) applied to the solenoid actuator 68. The fluid from the first chamber 12 is at a pressure such that the diaphragm 24 does not deflect. Also, the current applied to the solenoid actuator 68 in FIG. 6*a* does not move the spool 26 in the second axial direction 46. Therefore, as illustrated, the groove 62 of the spool 26 spans both the second fluid port 18 and the third fluid port 22. The edge 64 of the groove 62 does not cover the third fluid port 22, thereby allowing maximum fluid flow between the second and third fluid ports 18, 22. The spool spring 40 is also in its maximum expanded position forcing the spool 26 and rod 74 to the furthest position in the second axial direction 46.

If the current applied to the solenoid actuator 68 increases and/or the pressure of fluid from the first chamber 12 increases, the spool 26 moves in the second axial direction 46 as illustrated by FIG. 6*b*. In the first case, if the electric controller 92 increases current to the solenoid actuator 68, the control valve 2 elements are forced in the first axial direction 44 to decrease the fluid flow rate between the second and third chambers 16, 20. In the second case, the increase in pressure of fluid from the first chamber 12 causes the diaphragm 24 to deflect in the first axial direction 44. As a result, the force applied to the spool 26 by the diaphragm 24 via pin 36 decreases. If the solenoid actuator current is of a value to overcome the force applied by spool spring 40, the solenoid actuator 68 forces the spool 26 in the first axial direction 44, compressing the spool spring 40. The spool 26 stops at the position where the forces applied in the first axial direction 44 equal the forces applied in the second axial direction 46. The spool 26 may move to the illustrated position due to a combination of conditions described with respect to the first and second case as well. The edge 64 of the groove 62 partially covers the third fluid port 22 which decreases the fluid flow rate between the second and third chambers 16, 20.

FIG. 6*c* illustrates the spool 26 and diaphragm 24 in the maximum state of deflection. As discussed with respect to FIG. 6*b*, this may be a result of the current applied to the solenoid actuator 68, increased pressure from the first chamber 12, or a combination of both conditions. As illustrated, the distance of maximum diaphragm 24 deflection corresponds to a minimum flow rate between the second and third chamber 16, 20. The edge 64 of the groove 62 completely covers the third fluid port 22, thereby stopping the flow between the second and third chambers 16, 20. This state may not be desirable as it could introduce an overpressure situation. The control valve 2 may be designed to allow some flow between the second and third chambers 16, 20 during this state.

The functions of the elements described above may be better understood with respect to the control valve 2 application in a variable displacement compressor 100.

As discussed with respect to the prior art, a variable displacement compressor 100 comprises three main pressure chambers, which include the suction chamber 110, the discharge chamber 114, and the crankcase chamber 112. The suction chamber 110 connects to the first fluid port 14, the crankcase chamber 112 to the second fluid port 18, and the discharge chamber 114 to the third fluid port 22. The discharge chamber 114 contains refrigerant that is under high pressure. The fluid contained by the discharge chamber 114 is at a pressure greater than the fluid contained by either the suction chamber 110 or crankcase chamber 112. Further, the fluid pressure of the crankcase chamber 112 is greater than the fluid pressure in the suction chamber 110. Therefore, in order to increase the pressure in the crankcase chamber 112, the control valve increases the flow from the discharge chamber 114 to the crankcase chamber 112.

Figure 7A:
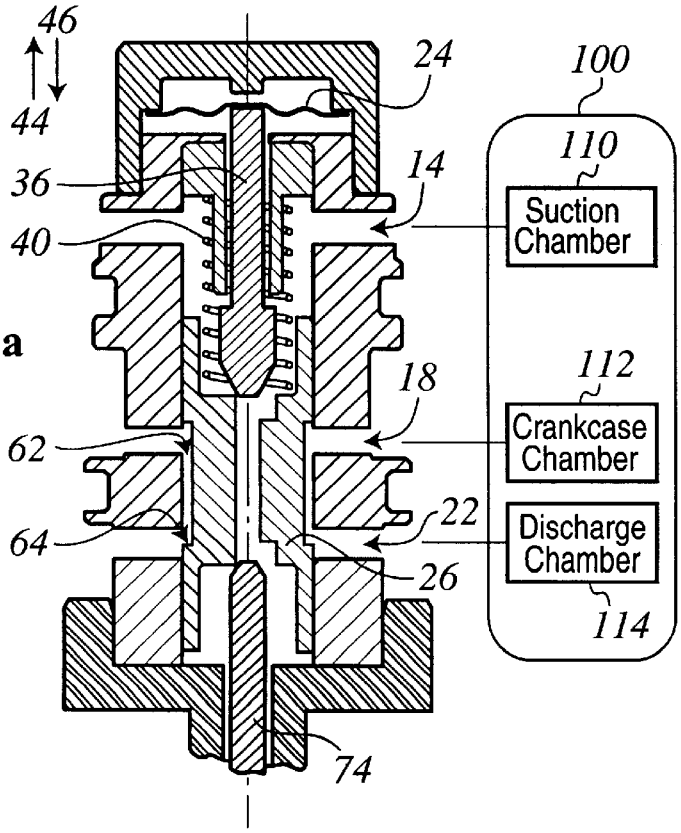
FIG. 7*a* schematically illustrates the valve housing connected to a variable displacement compressor with a diaphragm in a state of deflection.

The equilibrium point is the pressure differential (Pc−Ps) between the crankcase chamber 112 and the suction chamber 110. This equilibrium point also represents the point at which the force applied by the solenoid-actuator 68 equals the spool spring 40 and diaphragm 24 force. The suction pressure of the compressor 100 may increase due to a change in the system, such as an increase in thermal load on the evaporator. As illustrated by FIG. 7*a*, the increased suction pressure causes the diaphragm 24 to deflect in the first axial direction 44. The spool 26 moves in the same direction as a result of the force applied by the solenoid actuator 68. This causes the flow from the discharge chamber 114 to the crankcase chamber 112 to decrease as the groove edge 64 covers a portion of the third fluid port 22. Accordingly, the crankcase chamber 112 pressure decreases. Consequently, the pressure differential between the crankcase chamber and the suction chamber, Pc−Ps, also decreases. As a result, the pistons reciprocate at a higher stroke and thus higher compression and cooling capacity. The higher cooling capacity satisfies the increased thermal load on the evaporator.

Figure 7B:
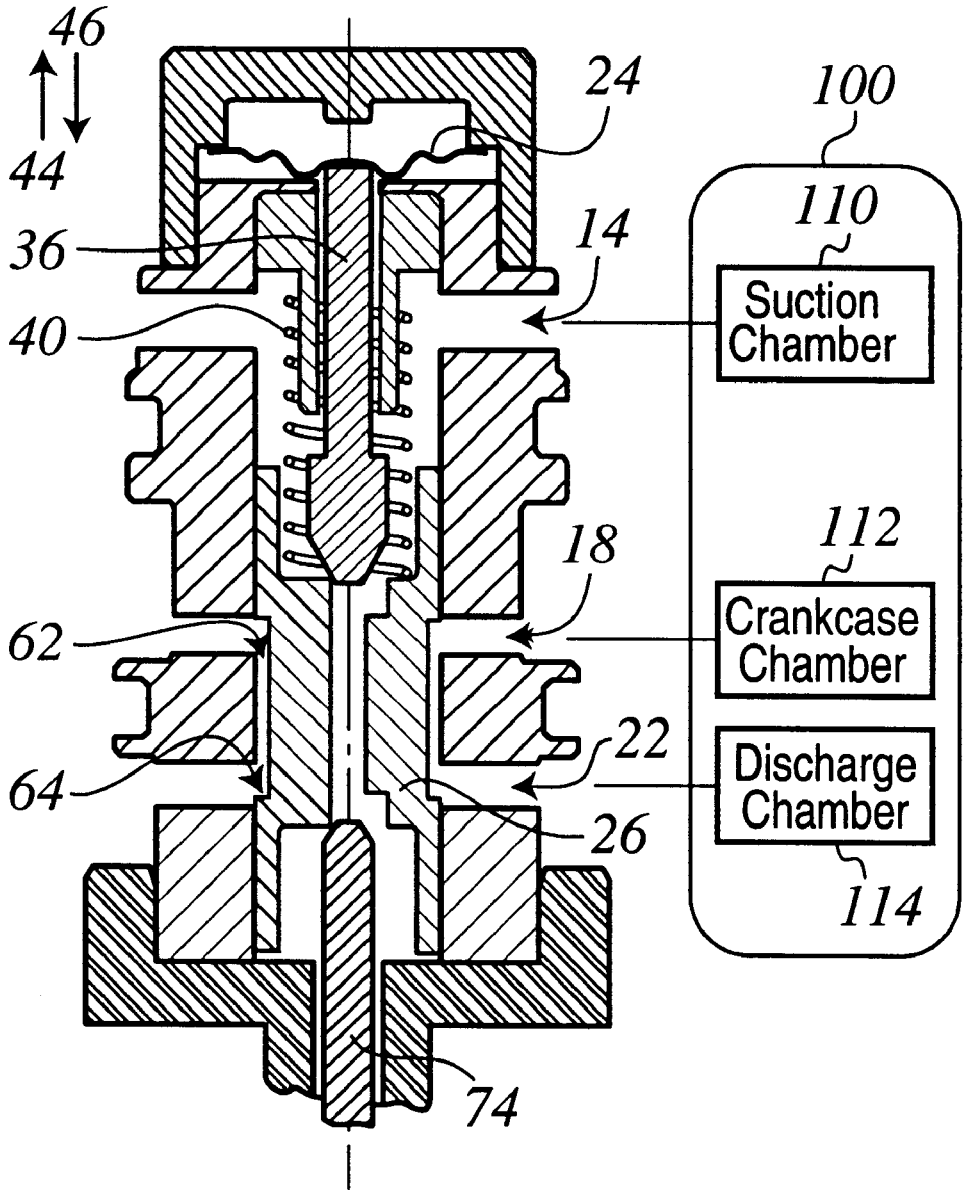
FIG. 7*b* schematically illustrates the valve housing connected to a variable displacement compressor with a diaphragm in a state of no deflection.

Referring to FIG. 7*b*, similarly, the suction pressure of the compressor 100 may decrease due to a decrease in required thermal load on the evaporator. Therefore, the diaphragm 24 deflects in the second axial direction 46 forcing the pin 36 against the spool 26. The spool 26 also moves in this direction and increases the flow from the discharge chamber 114 to the crankcase chamber 112, causing the pressure of the crankcase chamber 112 to increase. Consequently, the pressure differential Pc−Ps increases. As a result, the compressor de-strokes as a result of the lessening compression by the pistons. Therefore, the cooling capacity decreases as a result of the decreasing thermal load.

When minimum or no current is applied by the electrical controller 92 to coil 80, the spool spring 40 forces the spool 26 to a position such that the groove 62 spans both the second and third fluid ports 18, 22. The pressure differential at this point (Pc−Ps) is at a maximum value as the high pressure discharge fluid enters the crankcase chamber at a maximum rate. This corresponds to a minimum stroke condition and the least cooling capacity.

In order to increase the cooling capacity, an electrical controller 92 increases the applied current. The armature 72 is therefore forced in a first axial direction 44 by the magnetic force on the armature 72. The rod 74 forces the spool 26 in the first axial direction 44 so as to decrease the fluid flow from the discharge chamber 114 to the crankcase chamber 112. This position is also illustrated by FIG. 7*a*. At this point, the spool 26 encounters the resistant force applied by the diaphragm 24 via pin 36 due to the pressure of the suction chamber 110. A new equilibrium point is established where less fluid flows from the discharge chamber 114 to the crankcase chamber 112. This corresponds to a higher stroke position and a higher cooling capacity.

For example, assume the solenoid actuator 68 applied force corresponds to an equilibrium point of 50 kPa. Further assume that the fluid pressure in the suction chamber 110 is 75 kPa; the crankcase chamber 112 has a pressure of 125 kPa; and the discharge chamber 114 has a pressure of 150 kPa. Therefore, the pressure differential between the crankcase chamber 112 and the suction chamber 110 (Pc−Ps) is 50 kPa, which is currently at equilibrium. If the pressure in the suction chamber 110 increase to 100 kPa, the pin 36 causes the diaphragm 24 to deflect in the first axial direction 44. As a result, the solenoid actuator 68 forces the spool 26 in the first axial direction 44. The spool 26 movement decreases the fluid flow between the crankcase chamber 112 and the discharge chamber 114. As a result, the pressure of the fluid in the discharge chamber 114 will increase. The control valve 2 is designed to maintain the equilibrium point of 50 kPa. Therefore, the discharge chamber 114 pressure will increase to 175 kPa. Assume now that the fluid pressure in the suction chamber 110 drops to 50 kPa. This causes the diaphragm 24 to move in the second axial direction 46 forcing the spool 26 in the same direction. As a result, fluid from the discharge chamber 114 flows to the crankcase chamber 112 at an increased rate relieving the pressure in the discharge chamber 114. The fluid in the discharge chamber 114 will drop to a pressure of 100 kPa. In each case, the equilibrium point of 50 kPa is maintained.

As presented above, providing a control valve with a diaphragm and associated elements described above presents numerous advantages. The diaphragm occupies significantly less volume than does the bellows. Therefore, the control valve may be manufactured significantly smaller as well. Also, bellows have a tendency to wear against opposing surfaces effecting the resiliency of a control valve. The diaphragm of the present invention, being smaller and constructed from a rigid material, does not wear against opposing surfaces. As a result, the diaphragm and control valve have a substantially longer useful life.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. A variable displacement compressor comprising:

a compressor having a suction chamber, a crankcase chamber, and a discharge chamber wherein the crankcase chamber and discharge chamber are fluidly coupled by a valve for regulating the flow therebetween as a function of pressure in the suction chamber, the valve comprising:

a valve housing having a chamber fluidly coupled to the suction chamber, the crankcase chamber, and the discharge chamber, a fluid flow regulation member disposed in the chamber configured to regulate fluid flow between the crankcase chamber and the discharge chamber, and a diaphragm disposed substantially perpendicular to a longitudinal axis of the chamber defining a volume between the diaphragm and an end of the chamber, and acting on the fluid flow regulation member as a function of the pressure in the suction chamber, the amount of longitudinal deflection of the diaphragm being responsive to the pressure in the suction chamber, wherein the volume contains a gas having an expansion characteristic different from an expansion characteristic of a fluid received from the suction chamber by the valve housing.

2. The variable displacement compressor of claim 1 wherein the longitudinal deflection of the diaphragm acts on the fluid flow regulation member.

3. The variable displacement compressor of claim 1 wherein the diaphragm has an outer perimeter shape substantially corresponding to the shape of the chamber perpendicular to the longitudinal axis.

4. The variable displacement compressor of claim 1, further comprising:

an outer periphery of the diaphragm hermetically sealed to an inner wall of the chamber.

5. The variable displacement compressor of claim 1, wherein the gas is of a pressure corresponding to that of a vacuum.

6. The variable displacement compressor of claim 1, wherein the diaphragm deflects in a first axial direction with an increase of pressure of fluid in the suction chamber.

7. The variable displacement compressor of claim 1, wherein the diaphragm deflects in a second axial direction with a decrease of fluid pressure in the suction chamber.

8. The variable displacement compressor of claim 1, wherein the diaphragm is configured to deflect in a first axial direction as a function of increasing force acting on the diaphragm and deflect in a second axial direction as a function of decreasing force acting on the diaphragm.

9. The variable displacement compressor of claim 1 wherein the diaphragm further comprises:

an undulation having at least one ridge and at least one groove.

10. The variable displacement compressor of claim 9, wherein the undulation of the diaphragm compresses or expands along the axis perpendicular to the longitudinal axis of the chamber with the longitudinal deflection of the diaphragm.

11. The variable displacement compressor of claim 1 wherein the valve housing further comprises:

a valve body having a valve body cavity fluidly coupled to the suction chamber, the crankcase chamber, and the discharge chamber; and a cap positioned on a first end of the valve body creating a cap cavity separate from the valve body cavity wherein the valve body cavity and the cap cavity form the chamber.

12. The variable displacement compressor of claim 11, wherein the diaphragm is contained by the cap cavity of the chamber.

13. The variable displacement compressor of claim 11, wherein the valve housing further comprises:

an aperture in the first end of the valve body; and a pin reciprocating through the aperture with a first end interacting with the diaphragm and a second end interacting with the fluid flow regulation member.

14. The variable displacement compressor of claim 1, wherein the fluid flow regulation member further comprises:

a groove on the outer periphery of the member spanning a discharge chamber port and a crankcase chamber port through the valve housing through which fluid flows from the discharge chamber to the crankcase chamber;

a leading edge of the groove increasingly or decreasingly closing the crankcase chamber port or the discharge chamber port with movement of the fluid flow regulation member in a first or a second axial direction.

15. The variable displacement compressor of claim 1, further comprising:

a force means acting on the fluid flow regulation member opposing a force applied by the diaphragm.

16. The variable displacement compressor of claim 15, wherein the force means is adjustably responsive to conditions external to the compressor.

17. A control valve fluidly coupled to chambers containing fluid of different pressures for regulating flow therebetween comprising:

a valve housing having a chamber fluidly coupled to a first chamber, a second chamber, and a third chamber, a fluid flow regulation member disposed in the chamber configured to regulate fluid flow between the second chamber and the third chamber, and a diaphragm disposed substantially perpendicular to a longitudinal axis of the chamber defining a volume between the diaphragm and an end of the chamber, and acting on the fluid flow regulation member as a function of the pressure in the first chamber, the amount of longitudinal deflection of the diaphragm being responsive to the pressure in the first chamber, wherein the volume contains a gas having an expansion characteristic different from an expansion characteristic of a fluid received from the first chamber by the valve housing.

18. The control valve of claim 17 wherein the longitudinal deflection of the diaphragm acts on the fluid flow regulation member.

19. The control valve of claim 17 wherein the diaphragm has an outer perimeter shape peripheral substantially corresponding to the shape of the chamber perpendicular to the longitudinal axis.

20. The control valve of claim 17, further comprising:

an outer periphery of the diaphragm being hermetically sealed to an inner wall of the chamber.

21. The control valve of claim 17, wherein the gas is of a pressure corresponding to that of a vacuum.

22. The control valve of claim 17, wherein the diaphragm deflects in a first axial direction with an increase of pressure of fluid in the suction chamber.

23. The control valve of claim 17, wherein the diaphragm deflects in a second axial direction with a decrease of pressure of fluid in the suction chamber.

24. The control valve of claim 17, wherein the diaphragm is configured to deflect in a first axial direction as a function of an increasing force acting on the diaphragm and deflect in a second axial direction as a function of a decreasing force acting on the diaphragm.

25. The control valve of claim 17, wherein the diaphragm further comprises:

an undulation having at least one ridge and at least one groove.

26. The control valve of claim 25, wherein the undulation of the diaphragm compresses or expands along the axis perpendicular to the longitudinal axis of the chamber with the longitudinal deflection of the diaphragm.

27. The control valve of claim 17, wherein the valve housing further comprises:

a valve body having a valve body cavity fluidly coupled to the first chamber, the second chamber, and the third chamber; and a cap positioned on a first end of the valve body creating a cap cavity separate from the valve body cavity wherein the valve body cavity and the cap cavity form the chamber.

28. The control valve of claim 27, wherein the diaphragm is contained by the cap cavity of the chamber.

29. The control valve of claim 27, wherein the valve housing further comprises:

an aperture in the first end of the valve body;

a pin reciprocating through the aperture with a first end interacting with the diaphragm and a second end interacting with the fluid flow regulation member.

30. The control valve of claim 17, wherein the fluid flow regulation member further comprises:

a groove on the outer periphery of the member spanning a second chamber port and a third chamber port through the valve housing through which fluid flows between the second chamber and the third chamber;

a leading edge of the groove, increasingly or decreasingly closing the second chamber port or the third chamber port with movement of the fluid flow regulation member in a first or a second axial direction.

31. The variable displacement compressor of claim 17, further comprising:

a force means acting on the fluid flow regulation member opposing a force applied by the diaphragm.

32. The variable displacement compressor of claim 31, wherein the force means is adjustably responsive to conditions external to the compressor.

* * * * *